United States Patent [19]

Kerr

BEST AVAILABLE COPY

[11] 3,930,735

[45] Jan. 6, 1976

[54] TRAFFIC SURVEY SYSTEM

[75] Inventor: Joseph H. Kerr, Huntsville, Ala.

[73] Assignee: The United States of America as represented by the United States National Aeronautics and Space Administration, Washington, D.C.

[22] Filed: Dec. 11, 1974

[21] Appl. No.: 531,572

[52] U.S. Cl. ..... 356/167; 340/38 P; 356/71; 356/162

[51] Int. Cl.[2] ..... G08G 1/00

[58] Field of Search ..... 340/31 C, 38 P; 346/107 VD; 356/71, 162, 163, 165, 166, 167; 250/202, 549, 555

[56] References Cited

UNITED STATES PATENTS 2,899,857 8/1959 Rockafellow ..... 356/167

3,663,937 5/1972 Bolner ..... 340/31 C

*Primary Examiner*—Alfred E. Smith
*Assistant Examiner*—Richard A. Rosenberger
*Attorney, Agent, or Firm*—George J. Porter; L. D. Wofford, Jr.; John R. Manning

[57] ABSTRACT

This invention is of a traffic survey system in which an aerial photo survey transparency is first made of a significant survey area, for example, two kilometers square. The transparency is then optically scanned to check the position and size of vehicles on roadways in the area. By computer control comparison with a reference transparency wherein areas other than roadways are made opaque and roadways are made clear, scanning may be directed solely to roadway regions. Vehicle size analysis is accomplished by means of discrete holographic filters corresponding to selected size vehicles.

6 Claims, 2 Drawing Figures

TRAFFIC SURVEY SYSTEM

ORIGIN OF THE INVENTION

The invention described herein was made by an employee of the United States Government and may be manufactured and used by or for the Government of the United States of America for governmental purposes without the payment of any royalties thereon or therefor.

BACKGROUND OF THE INVENTION

1. Field of the Invention

This invention relates to a method and system for surveying traffic on roadways, and particularly to an automated survey method and system capable of determining both location and size of vehicles on roadways.

2. General Description of the Prior Art

Since the early 1930's when the number of cars on American highways and in American cities began to tax the capacity of assigned vehicle routes, attempts have been made to study traffic flow with the goal of improving traffic handling facilities and maximizing the flow in existing facilities. Basic to this goal is the timely and accurate gathering of traffic flow data. Although the models arising from traffic flow studies have been vigorously and exhaustively analyzed by competent transportation experts versed in abstract mathematics, the results obtained from these studies can be no more reliable than the data from which the models were abstracted and the degree to which the models represent reality. Therefore, the problem remains primarily one of data gathering.

In the past, techniques for gathering traffic flow data have varied widely in methodology and applicability of obtained data. One method was simply to place an observer at a point of interest such as a bridge or tunnel and have the observer count the number of vehicles passing this point. Usually a count was made for six minutes and this number multiplied by ten to obtain an average hourly flow. This method has met with a fair degree of success and applicability in the study of bottlenecks and other critical points in traffic flow; however, it is obvious that to generalize point functions to the continuum of traffic flow in a district would require a prohibitively large number of personnel to provide enough sample points and sample times to achieve realiable, timely data. Other methods have sought simply to automate this counting procedure. These have included photoelectric and electromagnetic transducers for vehicle detection and the familiar air-filled hose across the road for volume of flow measurements. Speed detection has relied primarily on radar speed detectors. Whether the method is a man on the street with a manual counter or a closed circuit camera tied to a digital computer, the results are essentially the same; and the cost of a thorough, reliable study is prohibitive.

It is, accordingly, an object of the present invention to provide an improved system of gathering and processing traffic data which is thorough and reliable and at the same time is much less expensive.

SUMMARY OF THE INVENTION

In accordance with the invention, an aerial photograph is made of an area having roads to be surveyed, for example, an area two kilometers square. From the photographs two transparencies are prepared, one being simply identical with the photograph, and the other, a reference transparency, would be modified to contrast roadway and non-roadway regions by making one region clear and the other opaque. Means are provided for optically comparing the transparencies and scanning the survey transparency whereby only objects on roadways would be detected as significant data. By optically filtering a scanning beam in terms of object size, the size of a vehicle on a transparency is determined. The position of the scanning beam is detected as an indication of the location of a vehicle on a roadway. Object location data and corresponding object size data are stored in a memory and may be readily recalled in a selected manner by an appropriately programmed address counter.

The vehicle size filtering is uniquely achieved by employing as the scanning beam a monochromatic light beam and sequentially interposing for each increment of roadway sample, e.g., a 2 meter square set of holographic replicas of different size vehicles. When there is a transmission from the transparency of a vehicle corresponding to the vehicle depicted by a particular holographic filter, a correlation condition exists and a significantly greater amount of light is passed by the filter than otherwise would be the case. Thus, by intensity detection, particular vehicle sizes are determined. By employing a memory having an address for each discrete area to be scanned on a roadway and as many subaddresses for each address as there are size filters. Vehicle location and size data may both be readily stored and recalled.

DETAILED DESCRIPTION OF THE DRAWINGS

Figures 1, 2:
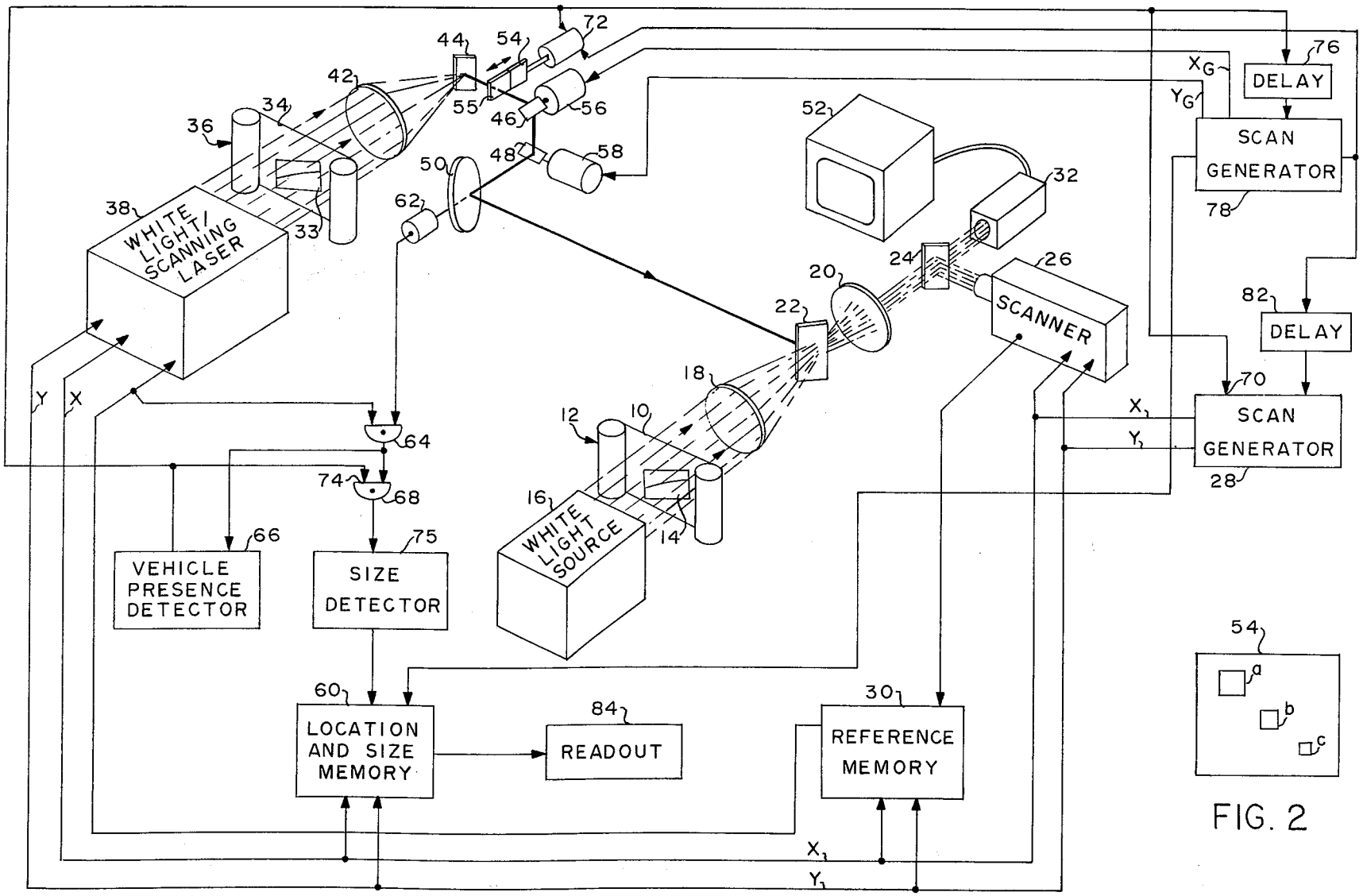
FIG. 1 is a schematic illustration of an embodiment of the invention.
FIG. 2 is a diagrammatic illustration of the arrangement of vehicle size filters employed by the invention.

The first function performed by the present invention is that of storing, as computer control data, information as to the location of roadways in a particular survey area. This data is initially in the form of phototransparencies on roll film 10 and selectively made available by film transport 12. Each transparency typically covers a block 2 kilometers square of terrain. The transparencies on roll film 10 are reference transparencies, that is, transparencies which have been modified to make opaque all portions other than where roadways exist and to make the roadways completely transparent. One of the reference transparencies, transparency 14, representantive of a particular square of terrain, is shown as being illuminated by white light source 16. The resulting image is projected by means of lenses 18 and 20, through image splitter 22, onto beam splitter 24, and then to optical scanner 26.

An example of optical scanner 26 would be a mosaic of phototransistors arranged in X-Y coordinate address positions and operated by X-Y scan generator 28. In this example, each phototransistor would view a discrete portion of transparency 14, representative of, for example, a two by two meter area of terrain portion of transparency 14. A phototransistor viewing a light or roadway area would thus respond with a maximum output, and one viewing a dark or non-roadway area would respond with a minimum output. Thus, in the computer would be a logical 1 output for light areas and a logical 0 output for dark or non-roadway areas.

The outputs of scanner 26 are fed to reference memory 30 which contains storage locations or addresses for each coordinate. With a matrix arranged memory, the location of the stored 1's would together duplicate the picture pattern of the roadways. It is to be appreciated, of course, that other scanning and memory systems may be employed.

The next step to be performed is that of optical alignment within the system of reference transparency 14 with that of an actual survey transparency of the same area showing traffic as it exists and is to be surveyed. This will enable the synchronized or coordinate recordation of data for an actual survey transparency with respect to that of the reference transparency and enable scanning of only portions of the survey transparency containing roadways.

To accomplish the alignment procedure, reference transparency 14 is again illuminated as before and the resulting image is projected onto TV camera 32. A corresponding survey transparency 33 is contained on roll film 34 and positionable by film transport 36 in the same manner as described above for film transport 12. Light source 38 projects a white light which illuminates transparency 33 to effect projection from the transparency through lens 42; mirror 44; mirrors 46, 48, and 50; through image splitter 22; lens 20; and image splitter 24 and to TV camera 32. In this manner, both images are projected on TV camera 32 and this alignment is achieved by positioning one of the film transports until visual alignment of the images are observed on TV monitor 52. During this operation, vehicle size filter 54 is withdrawn from the optical path and galvanometers 56 and 58, which effect the scanning function during size analysis, are not operated. Thus, mirrors 46 and 48 remain stationary. With alignment completed, computer control scanning of transparency 33, limited only to roadway areas of the transparency, may be effected.

The next function to be performed is that of recording the location and size of vehicles on roadways recorded on transparency 33. During this procedure, light source 38 comprises a scannable laser and is scanned in an X-Y coordinate format by conventional control mechanical means (not shown) under the control of X-Y scan generator 28. For example, the laser is possibly pointed to scan along columns and rows in X-Y coordinate steps, transparency 33. In order to achieve the selective scanning process mentioned above, laser 38 is only turned "on," or operative, during periods when its coordinate position is illuminating a roadway on transparency 33, scan generator 28 providing an X-Y signal to memory 30 coordinate with training of laser 38 which functions as an address signal to readout memory 30 for the same coordinate positions. Thus, memory 30 provides an indication, when so scanned, as to whether or not a portion of roadway is being instantaneously scanned by reading out a 1 or a 0 previously stored therein. 0 signals provide blanking signals to laser 38 to turn it off, and 1 signals function to turn laser 38 on. There is a beam output of laser 38 and illumination of transparency 33 only when its beam is directed on a roadway region recorded on transparency 14. At the same time, scan generator 28 provides coordinate address signals to location-size memory 60 to enable, in a manner to be described, the fact of resonance of a vehicle and its size whenever the vehicle is on a roadway.

Since transparency 33 is scanned by laser 38, the resulting image light pattern from the transparency is gathered by spherical lens 42 and transmitted by mirror 44 through filter 55 and mirrors 46 and 48 and through beam splitter 50 and photocell 62. A predetermined change in contrast of the image indicates the presence of a vehicle. This is detected by photocell 62. This change, as an output, of photo cell 62 is coupled from photocell 62 to an input of AND gate 64 which is enabled for an interval determined by an unblanking pulse from reference memory 30. As a result, an output of AND gate 64 is coupled as an input to vehicle presence detector 66 and as an input to second AND gate 68. Vehicle presence detector 66 provides an output control signal during the presence of an input. One of its outputs is coupled as an inhibit signal to input 70 of scan generator 28. This inhibit signal causes scan generator 28 to stop its scan and its then X-Y coordinate output to select the location in reference memory 30 and in location-size memory 60 indicative of the coordinate location of a detected vehicle. Scanning laser 38 remains deflected in its then position so as to maintain illumination of the vehicle during the next step, which is the establishment of the size of the vehicle.

Coincident with the inhibit signal supplied to scan generator 28, an output of vehicle presence detector 66 is also applied to vehicle size filter control 72 which then functions to remove filter 55 and to move filter 54 to intercept the image beam. Further, an output from vehicle presence detector 66 enables AND gate 68 at input 74 to accept an output of AND gate 64. Still further, an output of presence detector 66 is applied to delay 76, which responsively provides a delayed output as a scan initiate signal to scan generator 78. Thus, scan generator 78 is enabled after filter control 72 has moved size filter 54 into its operative position.

Size filter 54 consists of, for example, three discrete filter elements *a*, *b*, and *c* (FIG. 2), each of which is uniquely responsive to a particular size vehicle to pass a discrete intensity of light when illuminated by a diffraction pattern of a vehicle corresponding to the size of the vehicle encoded by that filter. For example, it will be assumed that filter element a encodes a large vehicle, element *b* encodes a medium size vehicle, and element *c* encodes a small size vehicle. As a particular feature of this invention, each of the filter elements comprises a hologram of one of these size vehicles, the hologram being recorded by phototransparencies. Thus, the designated filter elements *a*, *b*, and *c* are representative of discrete holograms. By virtue of the illumination of transparency 33 by laser 38, there occurs a holographic image pattern which simultaneously illuminates all of the holograms, this being accomplished by virtue of light gathering produced by lens 42. As is well known, the resulting interference patterns constituting the hologram are such that image information emanating from any point on transparency 33 will be distributed over the cross-section of the hologram, and thus although the holograms comprising filters *a*, *b*, and *c* are spaced as shown, each will receive the same information. The spacing is in accordance with a coded X-Y coordinate position arrangement, and thus by means of mirrors 46 and 48, which are positionable in an X-Y scanning mode by galvanometers 56 and 58, the light output from each hologram may be sequentially directed in a known coded time-sequence onto photocell 62.

Location-size memory 60 contains a memory address for each possible vehicle location which makes a scan (the area of transparency 33, representative of a two-by-two meter area). In addition, each address is broken down into three subaddresses so that when X-Y scan generator 28 stops scanning as a result of the detection of a vehicle at a particular X-Y location, scan generator 78 causes simultaneous scanning of filters or filter elements *a*, *b*, and *c* and subaddressing of the three subaddresses for that location, and thereby the recording in one of the subaddresses of a bit corresponding to the size vehicle encountered.

To examine the size detection process, it will be assumed that X-Y scan generator 28 has halted in response to a vehicle having been detected, size filter 54 is in an operative position, and scan generator 78 providing a first coordinate output whereby galvanometers 56 and 58 cause mirrors 46 and 48 to scan holographic filter *a*. At the same time, the scan coordinate signal from scan generator 78 is fed to location-size memory 60 to address an *a* subaddress for the location of the vehicle which has already been determined by a coordinate signal from scan generator 28. Thus, the output from filter *a* is detected by photocell 62 and if there occurs correlation between filter *a* and the holographic information being projected onto the filters from transparency 33, this condition will provide a maximum output. If no correlation exists, photocell 62 is adapted to provide a minimum output. If a maximum output, size detector 75 is adapted to provide a 1 logic output through AND gate 64 (enabled from a scan pulse from scan generator 28) and now enabled AND gate 68 to the *a* subaddress position for that vehicle address location of location-size memory 60. This would indicate that at this location there existed an *a* or large size vehicle. Next, scan generator 78 would provide a second coordinate signal to galvanometers 56 and 58, causing mirrors 46 and 48 to scan filter *b* and subaddress *b* of memory 60 to be enabled and, of course, the resulting output of photocell 62 would not be responsive to a correlated output from filter *b* which encodes a medium size vehicle, and thus a 0 would be recorded at that subaddress and address in location-size memory 60. The same events would occur to filter *c* and subaddress memory location *c*.

Thus, by the process outlined above, there would be recorded in location-size memory 60 a 1 in a subaddress for each address corresponding to the location of the vehicle. In this way, the presence of a "size" signal and an address would thus denote both the location and size of a vehicle.

Once the scanning of the three filters is completed, a "scan complete" signal is coupled from scan generator 78 as an output to delay 82, an output of which initiates scan generator 28 and causes scanning laser 38 to resume scanning and thus search for the next vehicle recorded on transparency 33.

In order to facilitate positive amplitude detection of the presence of a vehicle and a correlation condition between an image and a size filter, the light output from laser 38 may be either manually or automatically adjusted in accordance with the particular exposure characteristics of a particular transparency. This will ensure that only a single output is recorded in any one of three addresses for a given address.

The stored information in location-size memory 60 may be recalled and displayed by a conventional readout 84, its makeup depending upon the form of readout desired, e.g., coded cards or printed sheets. Data may be correlated to totalize the vehicles of a particular size, vehicle density, and by means of two or more adjacent area transparencies, vehicle speed of a particular vehicle may be determined. Thus, the present invention provides a versatile system for recording traffic survey information and one which enables surveys to be accomplished with reduced requirements insofar as manpower of monitoring roadways is concerned. Further, the data recorded is in such a form as to enable an almost unlimited data analysis of the information so gathered and without unduly large equipment requirements.

What is claimed is:

1. A traffic survey system comprising:

holding means for holding a transparency image frame of a discrete area containing at least one roadway;

light means including a beam of light positioned to project light on said transparency image frame and including beam positioning means responsive to an input scanning signal for causing said beam to scan discrete coordinately located areas of roadways on said transparency;

first scan generating means for generating a said scanning signal and supplying it to said light means, whereby said transparency image frame is scanned;

detection means responsive to light passed by said transparency for indicating the presence of a vehicle on a said roadway; and memory means responsive to said scan generating means and said detection means for storing an indication of the presence of a vehicle in a coded memory location.

2. A traffic survey system as set forth in claim 1 wherein said detection means further comprises filter means responsive to light passed by said transparency for indicating the size of a vehicle.

3. A traffic survey system as set forth in claim 2 wherein said light means comprises a source of monochromatic light, and said filter means comprises a plurality of holograms, each hologram comprising a holographic filter of a vehicle of a discrete size, whereby the vehicle size of a photographed vehicle is indicated by the particular filter emitting a discrete output of light.

4. A traffic survey system as set forth in claim 3 wherein:

said memory means includes a plurality of memory stage addresses, one for each selected said discrete coordinately located area of roadway to be scanned, and each said address comprising a plurality of memory stage subaddresses at least equal to the number of said holographic filters;

light detection means responsive to light from a said filter for providing an output upon the receipt of a selected amplitude of light;

said memory means is further responsive to a second scanning signal for storing a said indication of the presence of a vehicle in one of said subaddresses;

filter scanning means responsive to said second scanning signal for sequentially scanning light from said filters and directing the light from each filter to said light detection means; and second scan generating means for generating said second scanning signal and supplying said second scanning signal to said memory means and to said filter scanning means, whereby a location of a said vehicle is storable and indicated from the particular address of storage in said memory means and the size of the vehicle storable in and indicated by a particular one of said subaddresses where said indication of a said vehicle is stored.

5. A traffic survey system as set forth in claim 4 further comprising:

second holding means for holding a reference transparency image frame, a transparency image frame of the same overall area as that contained on said first-named transparency image frame but wherein, on said reference transparency, roadway areas and other areas are of opposite transmissivity;

second light means including means for illuminating said reference transparency image frame;

reference transparency scanning means responsive to said input scanning signal for scanning said reference transparency image frame and providing a first discrete output for scanned areas wherein there are roadways and a second discrete output where there are no roadways;

second memory means responsive to a said input scanning signal for storing in coordinate addresses, to addresses contained in said first-named memory means, said first discrete outputs indicative of coordinate areas of said reference transparency image frame wherein there are roadways, and storing second discrete outputs indicative of coordinate areas where there are no roadways; and memory read means responsive to the output of said second memory means for selectively enabling said light means responsive to a said first discrete output for operating said light means "on" and responsive to a said second discrete output for operating said light means "off," whereby only roadways are illuminated by said light means.

6. A traffic survey system as set forth in claim 5 wherein:

said system further comprises means for optically comparing the system position of a said transparency image frame and a said reference image transparency frame; and one of said holding means further comprising means for positioning a transparency image frame whereby the system position of a said transparency image frame may be made identical whereby memory location of image information in said memory means are coordinately located.

* * * * *